US005766660A

United States Patent [19]

Lee et al.

[11] Patent Number: 5,766,660

[45] Date of Patent: Jun. 16, 1998

[54] CONTAINER FOR STORING KIMCHI

[75] Inventors: Dong-Sun Lee, Changwon; Sheong-Ki Jeong, Suwon, both of Rep. of Korea

[73] Assignee: Samsung Electronics Co., Ltd., Suwon, Rep. of Korea

[21] Appl. No.: 542,334

[22] Filed: Oct. 12, 1995

[30] Foreign Application Priority Data

Oct. 14, 1994 [KR] Rep. of Korea ..... 1994-26387

[51] Int. Cl.[6] ..... B65D 85/00

[52] U.S. Cl. ..... 426/118; 426/8; 426/124; 426/395; 426/418; 426/419; 206/204; 206/205; 206/213.1; 220/361; 220/371; 422/102

[58] Field of Search ..... 426/418, 419, 426/395, 118, 124, 8; 206/204, 205, 213.1; 220/361, 371; 422/102

[56] References Cited

U.S. PATENT DOCUMENTS

| | | | |
|---|---|---|---|
| 4,134,535 | 1/1979 | Barthels et al. | 426/118 |
| 4,210,255 | 7/1980 | Pan | 426/419 |
| 4,890,637 | 1/1990 | Lamparter | 426/118 |
| 5,515,994 | 5/1996 | Goglio | 426/118 |

*Primary Examiner*—Lien Tran
*Attorney, Agent, or Firm*—Burns, Doane, Swecker & Mathis, L.L.P.

[57] ABSTRACT

A container for Kimchi includes a receptacle body and a detachable cap for the body. An underside of the cap carries a filter for removing Kimchi odors, an air vent extending from the filter to the exterior of the cap, and a microporous membrane extending across an outlet of the vent.

6 Claims, 4 Drawing Sheets

CONTAINER FOR STORING KIMCHI

BACKGROUND OF THE INVENTION

1. Field of the Invention

The present invention relates to a method for storing kimchi for a long time while preserving the characteristic flavors thereof. Also, the present invention is concerned with a container for Kimchi, which can store Kimchi for a long time and significantly improves the taste.

2. Description of the Prior Art

Kimchi, a traditional Korean food, is prepared by salting down cabbage or radish in salt water, dressing the salted cabbage or radish with various condiments, such as salt, powdered red pepper, garlic, ginger, green onion, pickled sea foods and so on, and fermenting the dressed cabbage or radish in a container for a certain time.

During fermentation, the cabbage and radish sugar is converted into organic acids, such as lactic acid, so that the kimchi becomes acidic. These organic acids play an important role in determining the flavor of Kimchi.

In addition, various gases including carbonic acid gas, nitrogen gas and oxygen are generated. Of these gases, carbonic acid gas also acts as a key factor in determining the characteristic flavor of Kimchi. In other words, carbonic acid is dissolved in the Kimchi giving it its characteristic cool and fresh flavor. The solubility of carbonic acid gas increases as the temperature decreases. Accordingly, in Korea, Kimchi has traditionally been prepared in late fall and stored in the ground, the temperature of which is suitable to ferment Kimchi properly for the winter season. Recently, by virtue of an advance in storing techniques, such as a refrigerator, Kimchi can be prepared irrespective of seasons.

In the former case, Kimchi is stored in a pot buried under ground for a very long duration. However, it is very inconvenient to have to retrieve and rebury the pot in order to remove portions of the Kimchi. In addition, it is virtually impossible for people living in apartments to bury pottery in the ground owing to the structure of the residence.

On the other hand, when using a refrigerator, Kimchi can conveniently be stored and retrieved. However, the closed Kimchi container is distorted by the inner pressure of increased gases, such as carbonic acid gas, nitrogen gas and oxygen gas, which are generated during fermentation.

Referring to FIG. 1, there are plotted the partial pressures of those gases with regard to fermentation time. As shown in this figure, the gas pressure increases with time, distorting the Kimchi container. In addition, the partial pressure of carbonic acid gas is relatively low, which results in a significant loss of the characteristic Kimchi flavor.

SUMMARY OF THE INVENTION

Based on intensive and thorough research by the present inventor, it was found that increasing the dissolved amount of carbonic acid gas in Kimchi, which can be accomplished by increasing the partial pressure of carbonic acid in the container while decreasing the partial pressures of the other gases, such as nitrogen gas and oxygen gas, improves the cool and fresh characteristic taste of Kimchi and retains it for a longer time.

The increase of dissolved carbonic acid gas in Kimchi is based on Henry's law:

$$C=kP_{CO2}$$

in which C is a concentration of dissolved in Kimchi $CO_2$ gas; $P_{CO2}$ is a partial pressure of $CO_2$ in a container; and k is a constant. As is apparent from the formula, the concentration of dissolved carbonic acid gas in Kimchi is directly proportional to the partial pressure of carbonic acid gas in a Kimchi container.

Accordingly, it is an object of the present invention to overcome the problems encountered in the prior art and to provide a method for storing Kimchi and to provide a container therefor, whereby Kimchi flavors can be much improved and retained for a longer time.

In accordance with an aspect of the present invention, there is provided a method for storing Kimchi, in which carbonic acid gas is increasingly generated in a container while restraining the generation of nitrogen and oxygen gases, thereby dissolving a large quantity of the carbonic acid gas in Kimchi.

In accordance with another aspect of the present invention, there is provided a container for Kimchi, comprising a receptacle body and a detachable cap, in which said detachable cap comprises a vent for air currents, a filter for removing the smell of Kimchi contained in the container air, a capillary tube for air currents which is connected both with said vent and said filter, and a microporous membrane which covers the vent.

Therefore, the container of the present invention significantly improves the Kimchi taste by increasing the amount of dissolved carbonic acid in the Kimchi and can easily remove the unwanted smell.

BRIEF DESCRIPTION OF THE DRAWINGS

Other objects and aspects of the invention will become apparent from the following description of embodiments with reference to the accompanying drawings in which.

DETAILED DESCRIPTION OF PREFERRED EMBODIMENTS OF THE INVENTION

The present invention relates to increasing the partial pressure of carbonic acid gas generated during fermentation of Kimchi in a container, so as to cause more of that gas to be dissolve in the Kimchi, which results in improving the characteristically fresh and cool Kimchi flavor.

To that end, an inorganic absorbent with the ability to absorb a large amount of carbonic acid gas, such as zeolite, may be set inside the container. At the early stage of the fermentation of Kimchi, the inorganic absorbent effuses the carbonic acid gas that it contains, and thus, the container becomes saturated with the gas in a short time. On the other hand, at the stage where the Kimchi is sufficiently fermented, the absorbent absorbs a large quantity of carbonic acid gas given off by the Kimchi and, when the partial pressure of carbonic acid gas is lowered in the container owing to, for example, the taking of Kimchi from the container, the absorbent releases carbonic acid gas into the container.

As mentioned above, temperature is important to the fermentation of Kimchi. Generally, higher temperature ferments Kimchi faster. Thus, in order to improve the Kimchi taste quickly, cabbage or radish dressed with various seasonings is fermented at ordinary temperatures. After becoming tasty, Kimchi is stored at a low temperature, for example, in a refrigerator, to retard the fermentation. Because the solubility of carbonic acid gas in Kimchi is increased when the Kimchi is refrigerated the partial pressures of various gases in the container is decreased, which induces the entry of external air into the container, deleteriously affecting the taste of Kimchi.

Accordingly, when Kimchi sufficiently fermented is stored at a low temperature, it is preferable that the container be tightly closed. The airtight container can prevent the inflow of external air into the container as the internal pressure is reduced due to the increased solubility of the carbonic acid gas in Kimchi. Therefore within the airtight container the amount of carbonic acid in the container will in increased (due to the presence of the absorbent) while the partial pressures of oxygen and nitrogen gases will be reduced, so that the characteristic Kimchi flavor of will be greatly improved.

Figure 1:
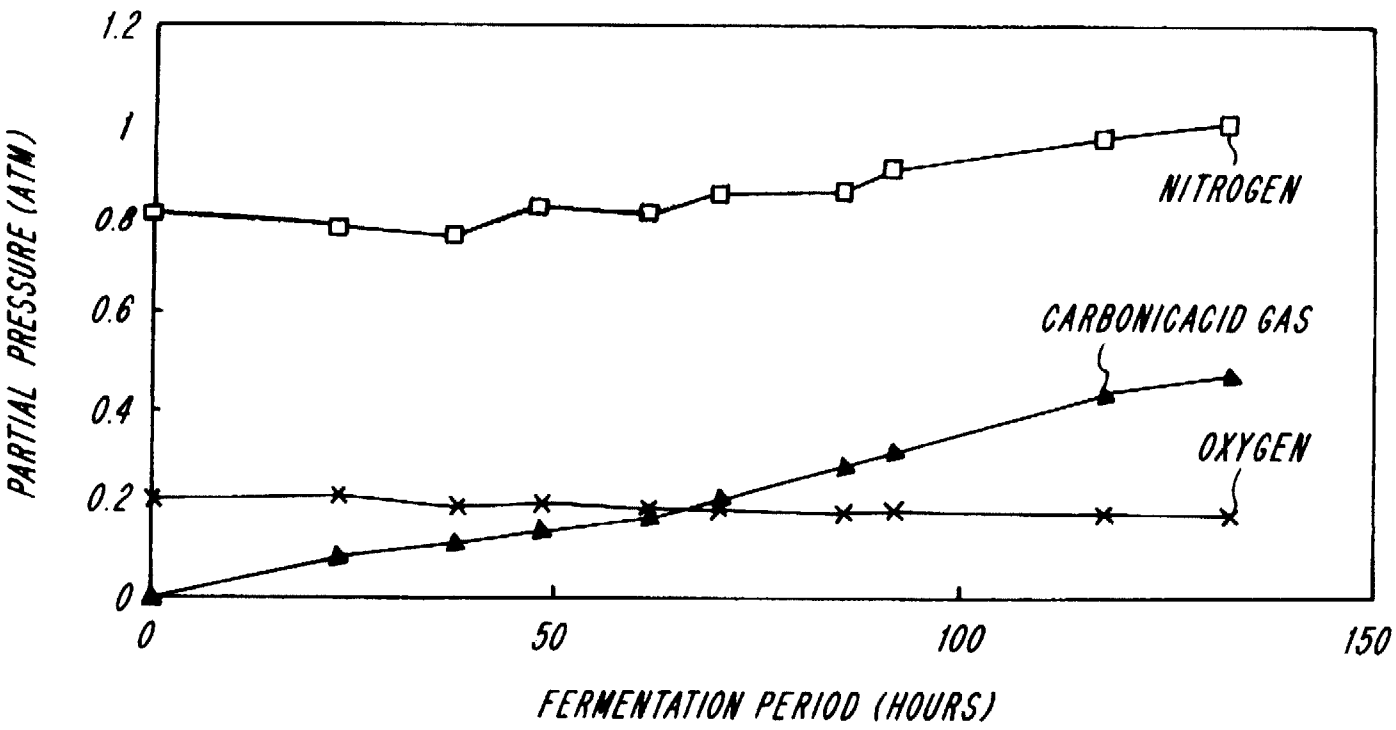
FIG. 1 (PRIOR ART)
FIG. 1 is a graph showing the change of partial pressures overtime of various gases generated during the fermentation of Kimchi in a conventionally closed container.
Figure 2:
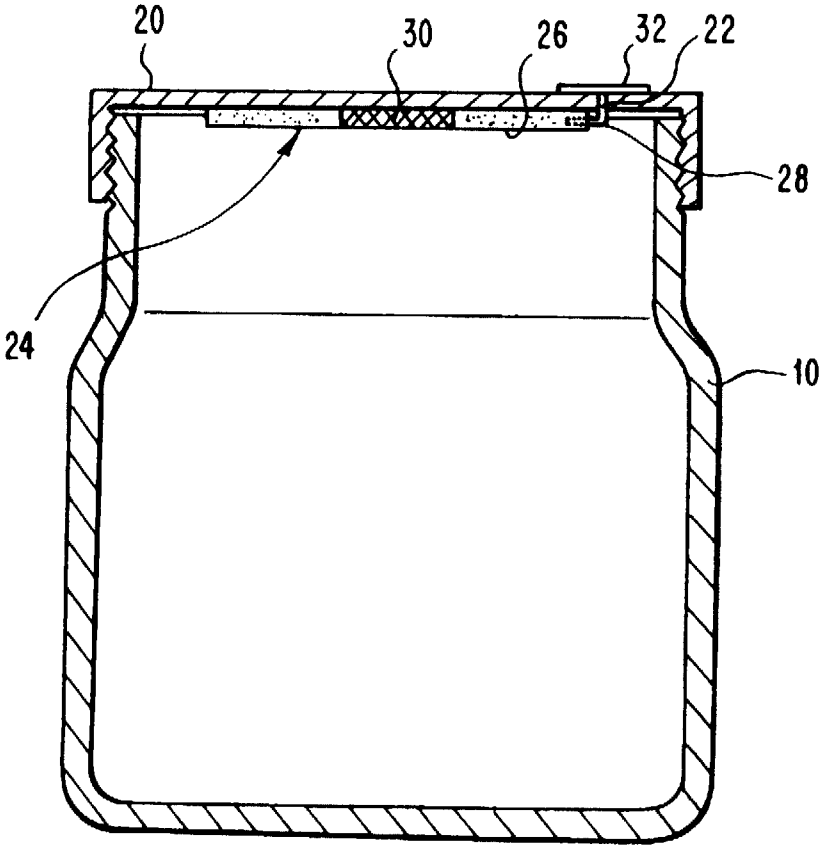
FIG. 2 is a cross sectional view showing a container according to the present invention.

Referring to FIG. 2, there is a Kimchi container according to the present invention. As shown in FIG. 2, it consists of a receptacle body 10 and a detachable cap 20. The receptacle body 10 and the cap 20 are both made of metal, synthetic resin or ceramics. The cap 20 can be brought into engagement with the receptacle body 10 by means of a screw thread, or a snap fit or forcible fit. It is preferable that the cap 20 easily engage with or separate from the receptacle body 10. The cap 20 has a vent 22 to conduct air to the inner side of the cap to which a filter is attached to prevent odors from flowing out or harmful microorganisms from flowing in. The filter 24 defines a reception part 26 which is connected with a capillary tube 28, so filtered air may flow out.

The size of the vent 22 depends on the size of the receptacle 10, the amount of Kimchi or the fermentation temperatures, and is preferably on the order of about 0.001 to 3 mm.

The filter 24 includes an absorbent 30 to remove the smell of Kimchi through absorption and is made of polyurethane or cellulose acetate fibers. As an absorbent 30, active carbon, zeolite or cristobalite is useful.

A microporous membrane 32 in which a large number of micropores are formed with a diameter of about 0.02 to 10 μm is attached to the outside of the vent 22 in such a way that it covers the vent 22, thereby preventing the smell of Kimchi from flowing out and alien substances from flowing in. Although it could be set inside the cap 20, it is recommended that the microporous membrane 32 be outside the cap 20 for easy attachment and detachment. The membrane 32 is formed of a material selected from the group consisting of nylon, polycarbonate, cellulose , polypropylene, polytetrafluorethylene, polystyrene, glass and ceramics.

A better understanding of the present invention may be obtained in light of the following examples which are set forth to illustrate, but are not to be construed to limit, the present invention.

EXAMPLE I

A vent 22 with a diameter of 0.2 mm was formed on a cap 20 for a receptacle 10 with an inner volume of 950 ml. An absorbent consisting of active carbon with a weight of 0.4 g was put in a filter 24 made of cellulose acetate fibers with a dimension of diameter 1.5 mm×length 42 mm, which was then attached to the inside of the cap 20. The reception part 26 was connected with the vent 22 through a capillary tube 28. On the outside of the vent 22 there was applied a membrane 32 in which a large number of micropores are formed with a diameter of 0.2 μm, to seal the container.

Then, 660 g of Kimchi with a salt concentration of 3% was placed in the receptacle body 10 which was then capped tightly with the cap 20. After being placed at a temperature of 17° C. for 3.7 days, the container was stored in a refrigerator set up 4° C. for 6.3 days.

Figure 3:
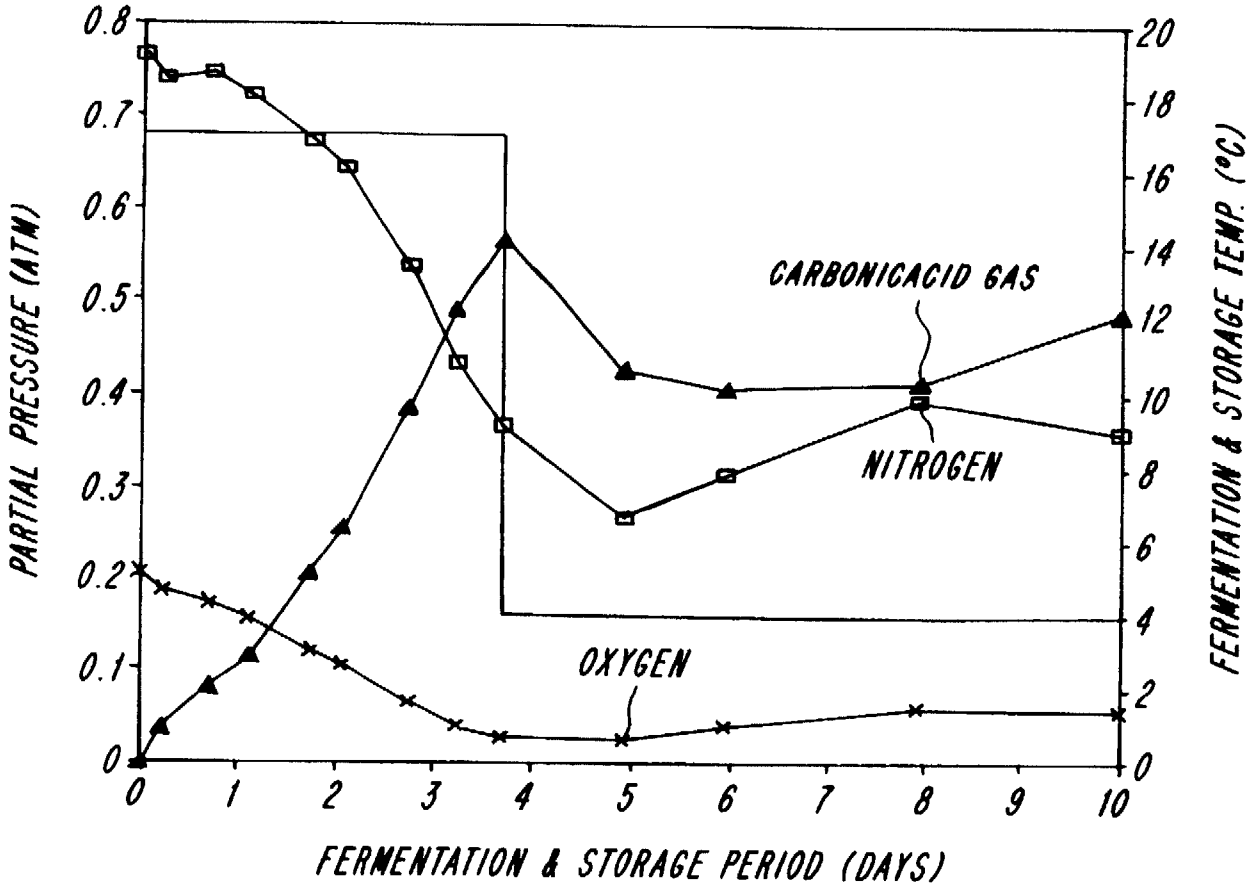
FIG. 3 is a graph showing the change of partial pressures of various gases generated during the fermentation of Kimchi in the container according to an embodiment of the present invention.

Changes in gas composition inside the container were measured during the fermentation and the results were as shown in FIG. 3. As is apparent from this graph, the partial pressure of carbonic acid gas increased during the fermentation and storage of Kimchi in the container whereas the partial pressures of oxygen and nitrogen gases decreased gradually.

Accordingly, a large quantity of carbonic acid gas was dissolved in Kimchi in the container, giving the characteristically fresh and cool taste.

The gases generated during the fermentation of Kimchi had the smell of Kimchi removed by the filter 24 and dissipated out through the micropores formed in the membrane 32. Thus, there was no smell of Kimchi in the refrigerator. Except for the pressure, little was changed in the container, compared to the prior art, so that the handling of the container, for example, uncapping, showed no problems.

EXAMPLE II

There were prepared a receptacle body 10 and a detachable cap 20 which were similar to those of Example I, except that an absorbent 30 consisted of an air-permeable nonwoven bag containing 5.2 g of zeolite. After absorbing a sufficient amount of carbonic acid gas, the zeolite stood for 10 days in a separate container which was saturated with 1 atm. of carbonic acid gas. During this period, carbonic acid gas was frequently injected into this container, so that the absorbent might be saturated with carbonic acid gas.

Figure 4:
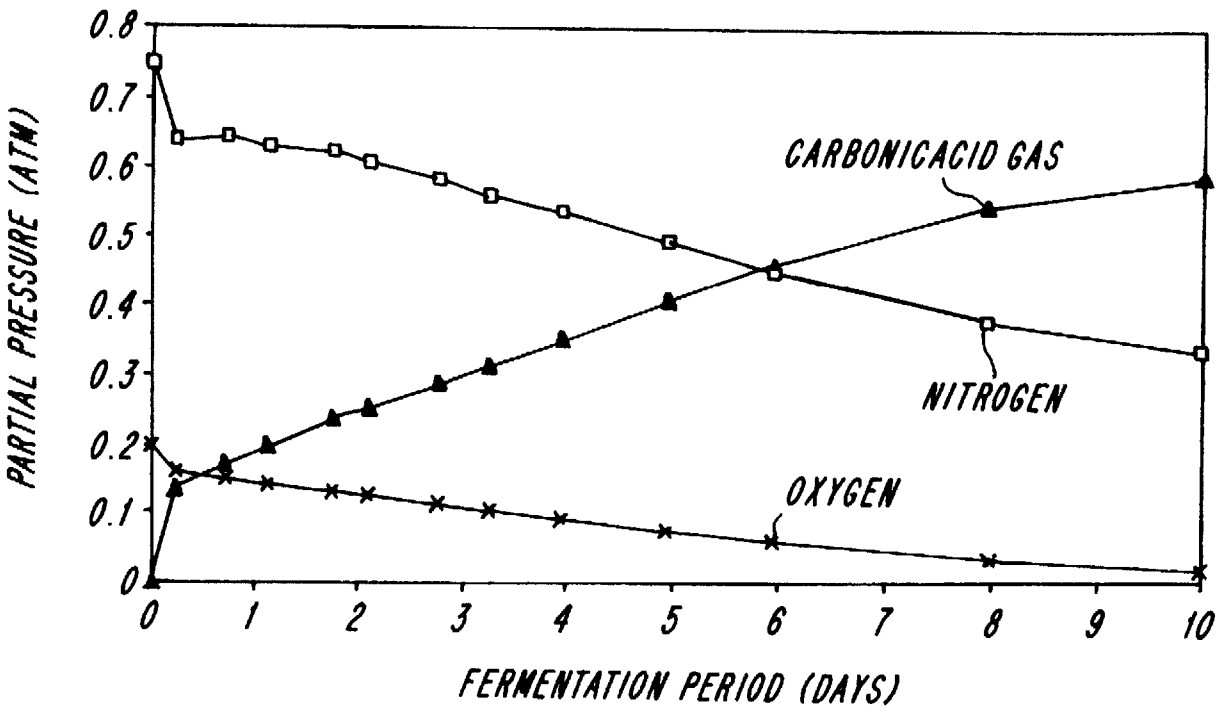
FIG. 4 is a graph showing the change of partial pressures of various gases generated during the fermentation of Kimchi in the container according to another embodiment of the present invention.

An amount of 660 g of Kimchi was placed in the receptacle body 10 and then subjected to fermentation at a temperature of 10° C. During the fermentation, the change of gas composition in the container was measured and the results were given as shown in FIG. 4. As apparent from this graph, a large quantity of carbonic acid gas was charged in the receptacle body 10 even at the early stage of the fermentation. Accordingly, the dissolved amount of carbonic acid gas in Kimchi was significantly increased.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A container for Kimchi, comprising a receptacle body having an opening, and a detachable cap mounted on said body for covering said opening; a Kimchi odor-absorbing material supported on an underside of said cap and disposed within said body for removing Kimchi odors, an air vent extending from said absorbing material to an exterior of said cap, and a microporous membrane covering an outlet of said vent such that a flow of air through said vent is controlled by said microporous membrane which prevents alien substances from flowing into said receptacle body, wherein said absorbing material is an active carbon.

2. A container for Kimchi in accordance with claim 1, wherein said vent has a diameter of about 0.01 to 3 mm.

3. A container for Kimchi in accordance with claim 1, wherein said microporous membrane comprises a number of micropores through which air flows.

4. A container for Kimchi in accordance with claim 3, wherein said micropores have a diameter of about 0.02 to 10 μm.

5. A container for Kimchi, comprising a receptacle body having an opening, and a detachable cap mounted on said body for covering said opening; a Kimchi odor-absorbing material supported on an underside of said cap and disposed within said body for removing Kimchi odors, an air vent extending from said absorbing material to an exterior of said cap, and a microporous membrane covering an outlet of said vent such that a flow of air through said vent is controlled by said microporous membrane which prevents alien substances from flowing into said receptacle body, wherein said absorbing material is zeolite.

6. A container for Kimchi, comprising a receptacle body having an opening, and a detachable cap mounted on said body for covering said opening; a Kimchi odor-absorbing material supported on an underside of said cap and disposed within said body for removing Kimchi odors, an air vent extending from said absorbing material to an exterior of said cap, and a microporous membrane covering an outlet of said vent such that a flow of air through said vent is controlled by said microporous membrane which prevents alien substances from flowing into said receptacle body, wherein said absorbing material is cristobalite.

* * * * *